US007216387B2

(12) United States Patent
Laxton

(10) Patent No.: US 7,216,387 B2
(45) Date of Patent: May 15, 2007

(54) ARCHED PILLOW ASSEMBLY

(76) Inventor: Scott Laxton, 34 Garfield Dr., Newport News, VA (US) 23608

( * ) Notice: Subject to any disclaimer, the term of this patent is extended or adjusted under 35 U.S.C. 154(b) by 26 days.

(21) Appl. No.: 11/153,448

(22) Filed: Jun. 16, 2005

(65) Prior Publication Data

US 2006/0282952 A1 Dec. 21, 2006

(51) Int. Cl.
*A47C 17/86* (2006.01)

(52) U.S. Cl. ..... 5/636; 5/646; 5/485

(58) Field of Classification Search ..... 5/636, 5/639, 643, 646, 490, 485
See application file for complete search history.

(56) References Cited

U.S. PATENT DOCUMENTS

| | | | | |
|---|---|---|---|---|
| 324,785 | A | 8/1885 | Pitney | |
| 2,521,530 | A | 9/1950 | McGuffage | |
| D198,449 | S | 6/1964 | Kerr | |
| 3,251,075 | A | 5/1966 | Saltness et al. | |
| 3,757,365 | A * | 9/1973 | Kretchmer | 5/636 |
| 3,883,906 | A | 5/1975 | Sumpter | |
| 4,285,081 | A | 8/1981 | Price | |
| D328,682 | S | 8/1992 | Carney | |
| 5,579,551 | A | 12/1996 | Tommaney | |
| 5,604,944 | A * | 2/1997 | Meade | 5/643 |
| 5,644,809 | A | 7/1997 | Olson | |
| D397,270 | S | 8/1998 | Maalouf | |
| 5,907,876 | A * | 6/1999 | Schwabe | 5/646 |
| 6,041,458 | A | 3/2000 | Vickers et al. | |
| 6,073,288 | A * | 6/2000 | Berenstein | 5/636 |
| 6,079,066 | A | 6/2000 | Backlund | |
| 6,098,220 | A * | 8/2000 | Momma | 5/636 |
| 6,336,236 | B1 | 1/2002 | Dalton | |
| 6,518,762 | B2 * | 2/2003 | Van De Spijker | 324/318 |
| D741,050 | | 3/2003 | Haubner | |
| 6,581,226 | B1 * | 6/2003 | Brustein | 5/643 |
| D484,727 | S | 1/2004 | Haywood | |
| 6,671,907 | B1 * | 1/2004 | Zuberi | 5/636 |
| D487,207 | S | 3/2004 | Manuel | |
| 6,845,534 | B1 * | 1/2005 | Huang | 5/639 |
| 6,918,148 | B2 * | 7/2005 | Auxila | 5/655 |
| 7,017,215 | B1 * | 3/2006 | Singer et al. | 5/646 |

FOREIGN PATENT DOCUMENTS

| | | |
|---|---|---|
| WO | WO 03/096849 | 5/2002 |

* cited by examiner

*Primary Examiner*—Brian E. Glessner
*Assistant Examiner*—Jonathan Liu
(74) *Attorney, Agent, or Firm*—Richard C. Litman

(57) ABSTRACT

The arched pillow assembly allows a user to comfortably sleep with an arm underneath his or her head and a pillow without restricting the circulation of blood through the arm. The arched pillow assembly includes a pillowcase that holds a conventional pillow and has two spaced apart pockets attached to the bottom of the pillowcase for snugly receiving and holding a rigid arch support. Once placed on a resting surface, the arch support has a radius of curvature sufficient to form a channel thereunder for accommodating the passage of an extended arm. The arch is strong enough to support the head of the user and the pillow in an elevated position above the extended arm and the resting surface, thereby preventing the weight of the head and pillow from restricting proper circulation of blood through the extended arm.

6 Claims, 7 Drawing Sheets

ARCHED PILLOW ASSEMBLY

BACKGROUND OF THE INVENTION

1. Field of the Invention

The present invention relates to pillows. More specifically, the present invention is an arched pillow assembly that allows a user to comfortably sleep with an arm underneath his or her head without disrupting the circulation of blood through the arm.

2. Description of the Related Art

Conventional pillows provide a cushioned support in which the degree of cushioning and comfort varies depending on what material is used to make the pillow. People typically use pillows to support their heads in a comfortable position, especially during slumber. This can be problematic when the user places an arm beneath the pillow with his or her head directly above the arm. In such a resting position, the circulation of blood in the arm is hindered, as the weight of the resting head alone or in conjunction with a pillow occludes the flow of blood. Disrupting the circulation of blood in the arm may result in numbness or other problems that can materially affect the quality of sleep and health of the user.

Although various pillows on the market are designed to address the aforementioned loss of circulation in the arm during sleep or other activities, such pillows are often shaped oddly, aesthetically unpleasing, and incompatible with existing pillows and bedroom decor. Thus, a pillow assembly solving the aforementioned problems is desired.

SUMMARY OF THE INVENTION

The arched pillow assembly allows a user to comfortably sleep with an arm underneath his or her head and a pillow without disrupting the circulation of blood through the arm. The arched pillow assembly includes a pillowcase that holds a conventional pillow and has two spaced apart pockets permanently or releasably attached to the bottom of the pillowcase for snugly receiving and holding a generally rigid arch support. The generally rigid arch support is comprised of a rigid arcuate component that is covered with a thin layer of cushioning material Once placed on a resting surface, the arch support has an interior radius sufficient enough to create a channel thereunder for accommodating the passage of an extended arm. Moreover, the generally rigid arch is sturdy enough to support the head of the user and the pillow in an elevated position above the extended arm and the resting surface, thereby preventing the weight of the head and pillow from hindering proper circulation of blood through the extended arm. In addition, the user reaps maximum respiratory and orthopedic comfort when the user sleeps with his or her head on the portion of the pillow supported just above the apex of the arch support.

The arched pillow support can also readily be used as a backrest when sitting up in bed or as an infant support on or above the lap of a person feeding the infant while seated. Moreover, the arched pillow assembly can be manufactured in different sizes to accommodate persons of varying size. The pillowcase can be made in a vast assortment of colors, styles, and patterns to appeal to the tastes of users.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
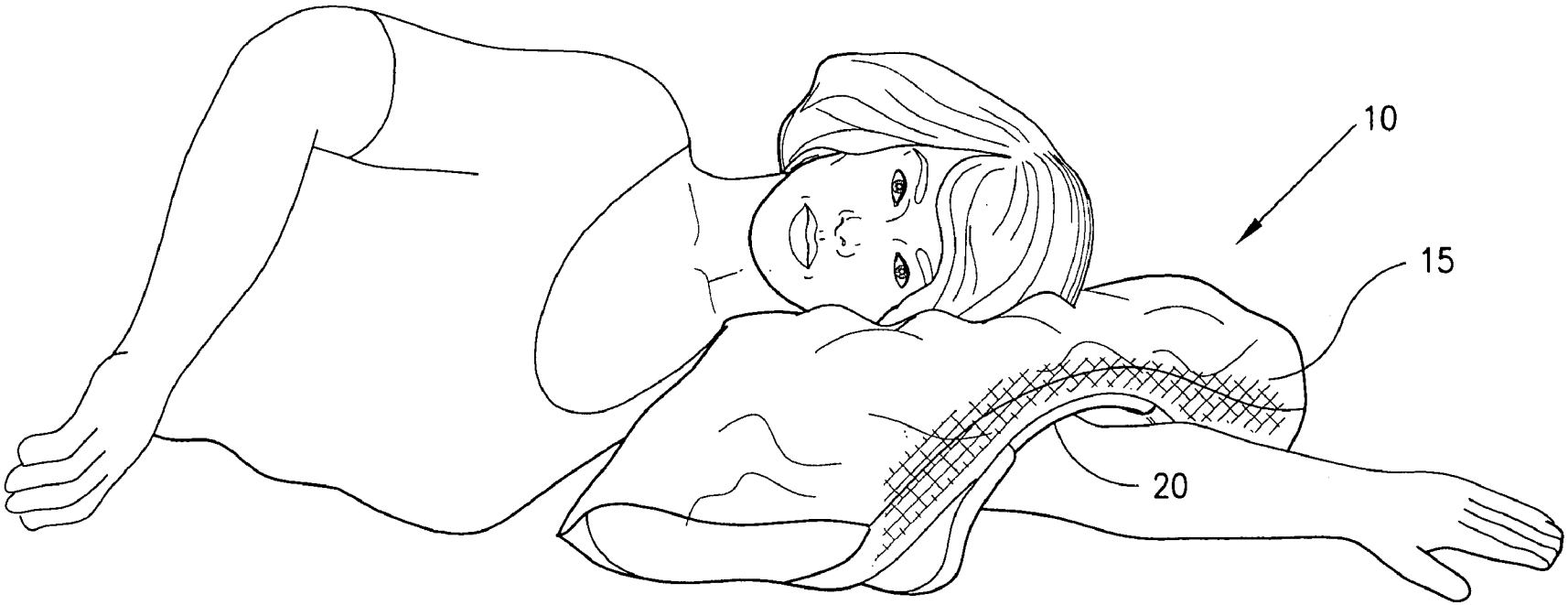
FIG. 1 is an environmental, perspective view of the arched pillow assembly according to the present invention.

The present invention is an arched pillow assembly, designated generally as 10 in the drawings, that allows a user to comfortably sleep with either arm underneath the head. In contrast to a conventional pillow, the arched pillow assembly 10 elevates and supports the head above the mattress and arm, thereby preventing the weight of the head from restricting circulation through the arm.

Figure 2:
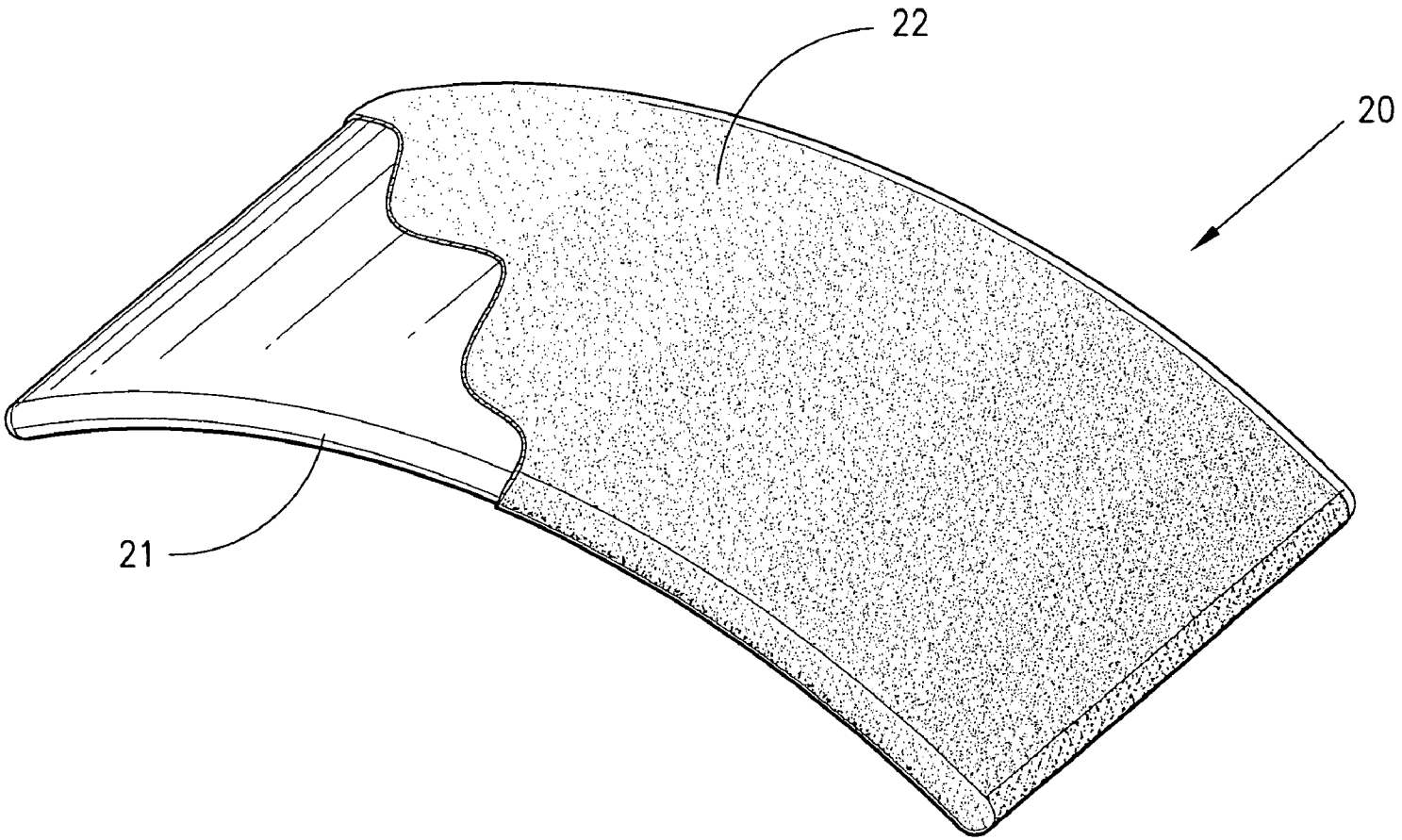
FIG. 2 is a perspective view of an arch support of the arched pillow assembly according to the present invention.
Figure 3:
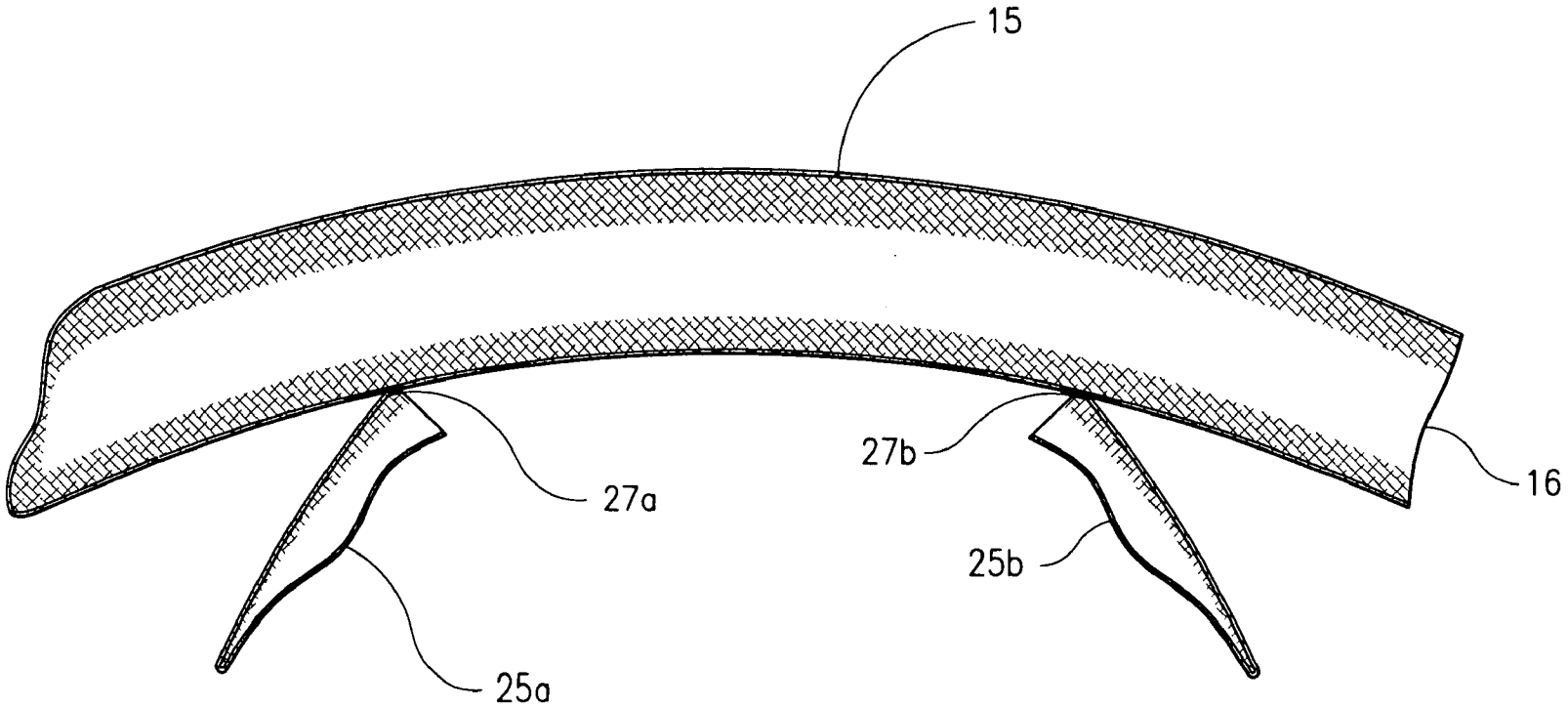
FIG. 3 is a partial side view of the pillowcase of the arched pillow assembly according to the present invention.

Referring to FIGS. 1–3, the arched pillow assembly 10 includes a pillowcase 15 having pockets 25*a*, 25*b* that are attached to the bottom of the pillowcase 15 and designed to receive the opposing ends of the arch support 20. As shown in FIG. 1, once placed on a mattress or other sleeping surface, the arched pillow assembly 10 elevates and comfortably supports the head of a user over his or her arm to ensure proper circulation.

Referring to FIGS. 1–2, the arch support 20 provides a channel of sufficient width and height beneath a user's head through which a user may extend his or her arm once the arched pillow assembly 10 is placed on a sleeping surface. The arch support 20 has a rigid arch component 21 covered with a thin layer of cushioning material 22. The arch component 21 has a radius of curvature that is of sufficient width and height to accommodate an arm that is passed through the arch support 20 once the arched pillow assembly 10 is placed on a sleeping surface. The arch component 21 is made from a material, such as plastic, that is rigid and strong enough to support the head of the user in an elevated position above the arm. A thin layer of foam or like cushioning material 22 covers and protects the entire arch component 21. The arch component 21 can be manufactured in a range of sizes to accommodate children, adolescents, and adults of varying sizes.

Referring to FIGS. 1 and 3, pillowcase 15 has dimensions and a configuration similar to a conventional pillowcase, but with two pockets 25*a*, 25*b* permanently affixed to the bottom of the pillowcase 15. The pillowcase 15 has an open end 16, like conventional pillowcases, for receiving a conventional pillow to be held within the pillowcase 15. The pillowcase 15 is made from fabric, either natural or synthetic. The pillowcase 15 can be manufactured in a variety of colors, styles, and patterns to suit the tastes of users.

Referring to FIG. 3, the top edge 27*a* of the opening of a first pocket 25*a* is attached to the bottom of the pillowcase 15 at a point approximately midway between one end and the center of the pillowcase 15. The top edge 27*b* of the opening of a second pocket 25*b* is attached to the bottom of the pillowcase 15 at a point approximately midway between the opposing end and the center of the pillowcase 15. The pockets 25*a*, 25*b* are stitched to the bottom of the pillowcase in the preferred embodiment, but other suitable methods of fastening may be used. For example, the pockets 25*a*, 25*b* can be releasably attached to the pillowcase 15 using various fastening systems, such as a hook and loop fasteners. Resilient fabric, nylon, or like material with sufficient stretching qualities to facilitate receiving the arch support 20, which will be explained momentarily, can be used to construct the pockets 25*a*, 25*b*, if desired.

Figure 4:
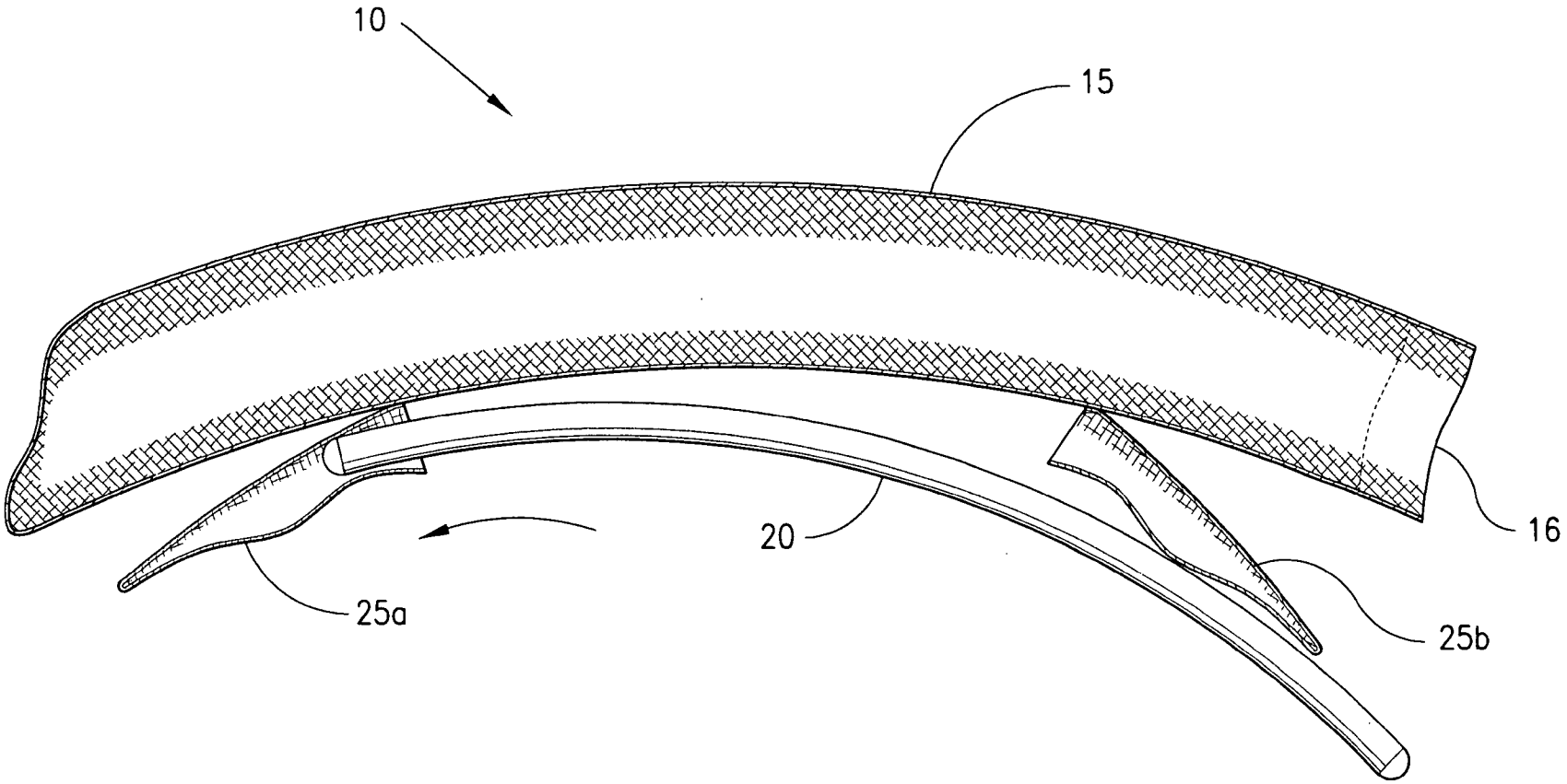
FIG. 4 is a partial side view of the pillowcase showing insertion of one end of the arch support in one of the pockets of the pillowcase of the arched pillow assembly according to the present invention.
Figure 5:
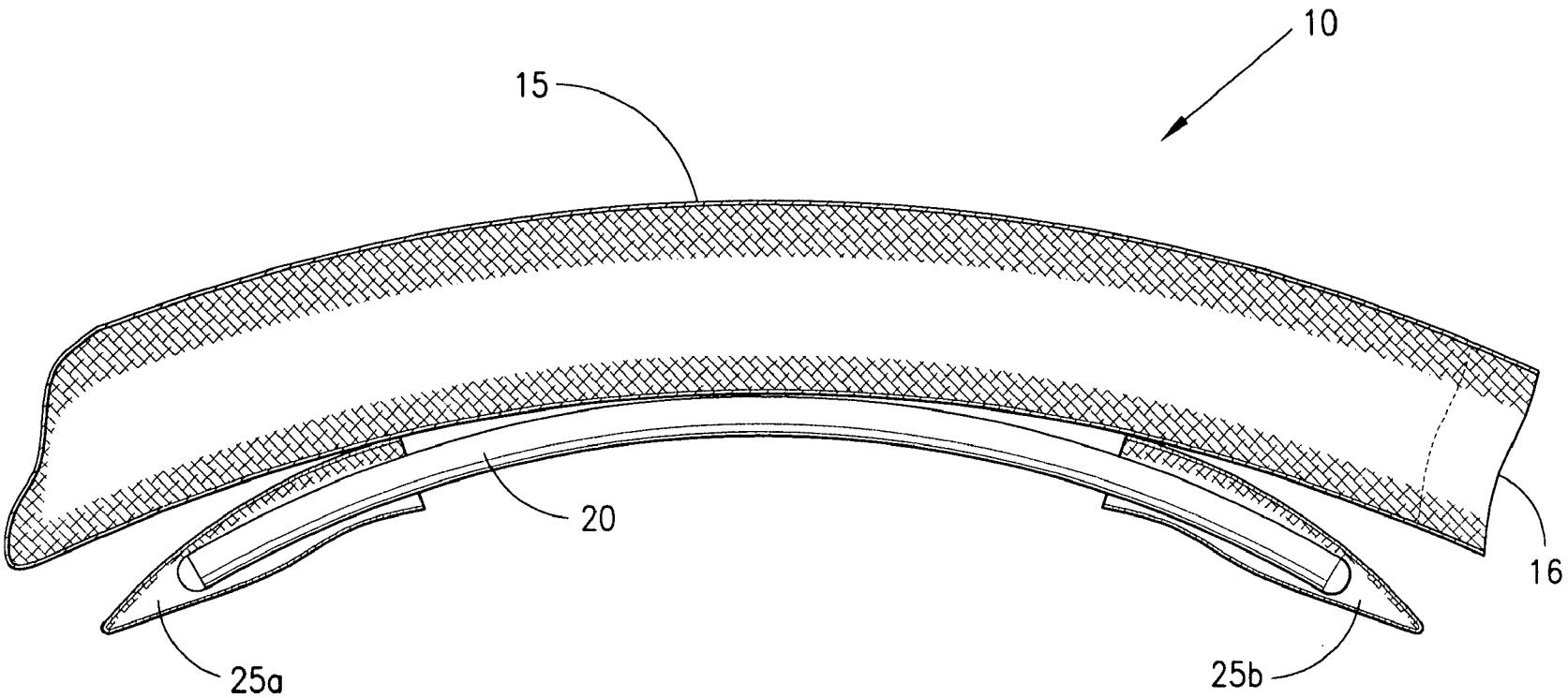
FIG. 5 is a side view of the pillowcase showing both ends of the arch support received in the pockets of the pillowcase of the arched pillow assembly according to the present invention.

As best seen in FIG. 4, a first end of the arch support 20 is placed in pocket 25*a*. The opening of the pocket 25*a* expands to receive one end of the arch support 20, which is inserted until it completely fills the pocket 25*a*. Referring to FIG. 5, the opposing end of the arch support 20 is subsequently placed through the opening in pocket 25*b* and held therein. Once the ends of the arch support 20 are snugly received in the pockets 25*a*, 25*b*, the pillowcase 15 and arch support 20 can be moved in unison without worry of separation.

Figure 6:
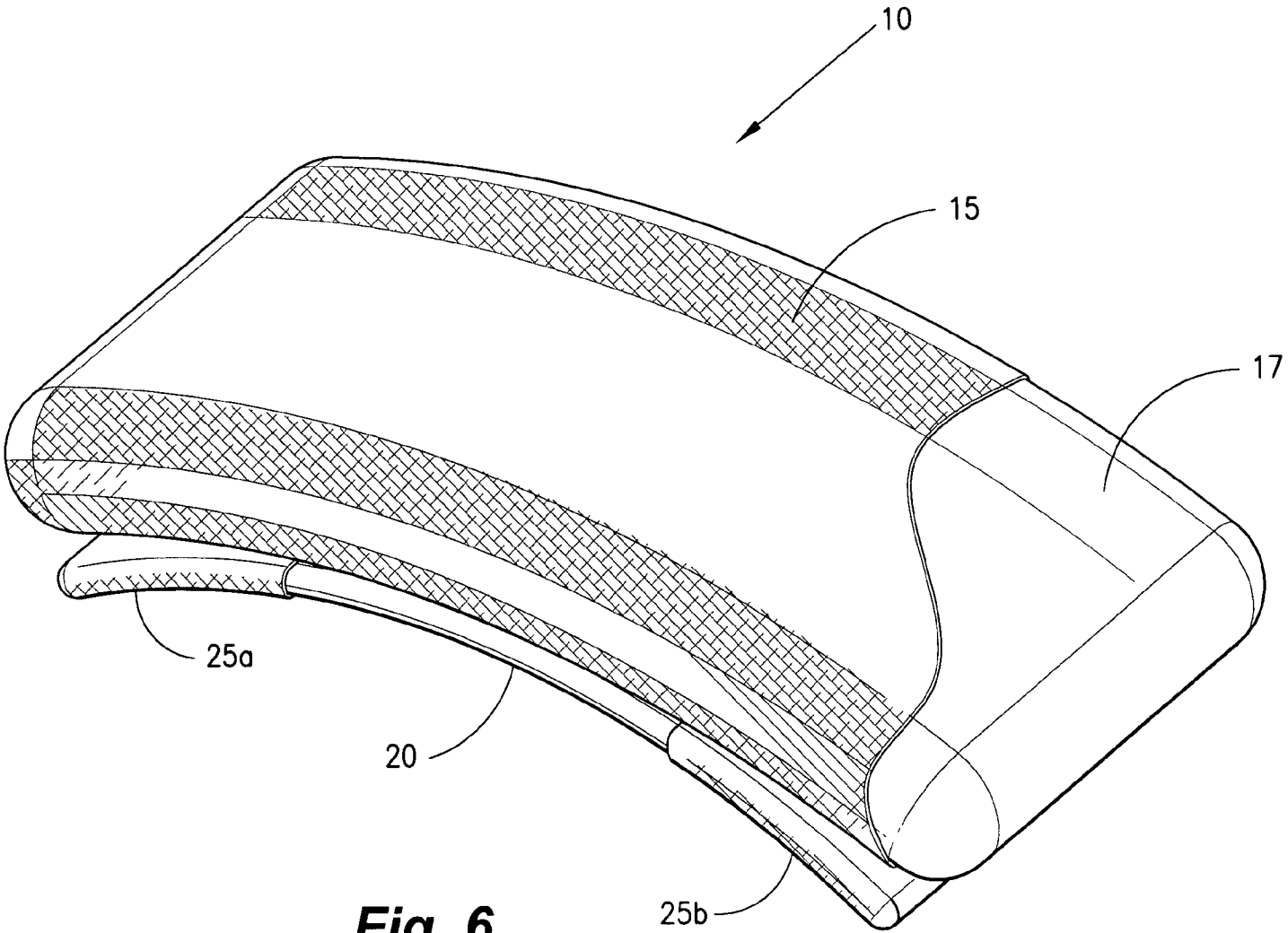
FIG. 6 is a top perspective view of the arched pillow assembly of the present invention with the pillowcase broken away to show a pillow.
Figure 7:
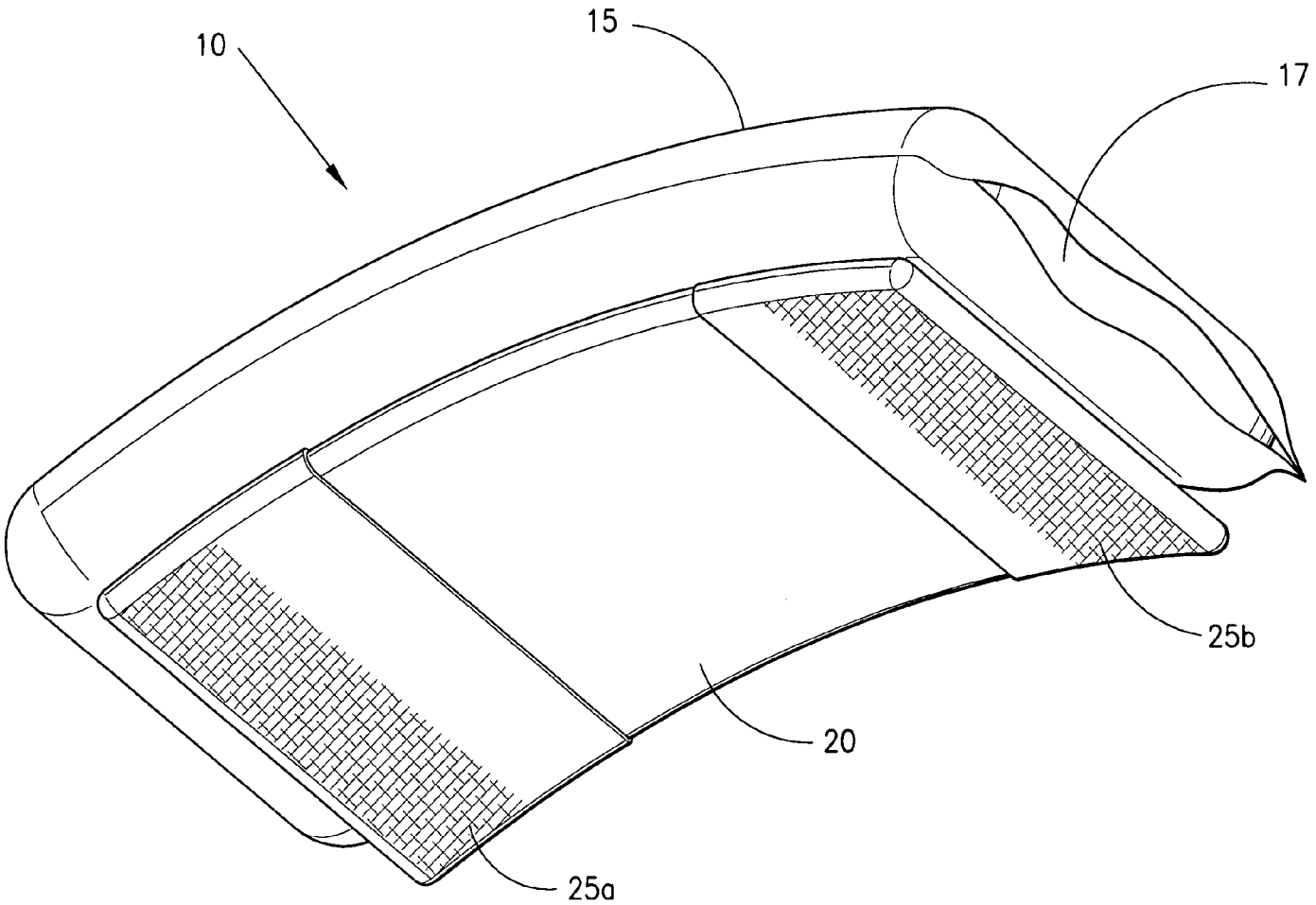
FIG. 7 is a bottom perspective view of the arched pillow assembly according to the present invention.

Referring to FIGS. 6–7, a conventional pillow 17 placed inside the pillowcase 15. The pillow 17 provides a comfortable cushion between the head of the user and the arch support 20, thereby enhancing the quality of sleep. As seen in FIG. 1, the user sleeps with his or her head on the portion of the pillow 17 above the apex of the arch support 20. The pillow 17 and arch support 20 can be easily removed from the pillowcase 15 when the user desires to launder or store the pillowcase 15.

Alternatively, the arched pillow assembly 10 can be propped up against a headboard or wall and used as a backrest when a user desires to sit up in bed for the purposes of reading and the like, thereby reducing stress on the back of the user while enhancing comfort. Moreover, the arched pillow assembly 10 can also be used to comfortably support an infant on or above the lap of person feeding the infant, thereby relieving the caregiver from the necessity of holding the infant in his or her arms.

The arched pillow assembly may be provided as an original equipment manufacture, or existing pillowcases may be retrofitted with releasably attached or permanently attached pockets 25*a*, 25*b* to receive and hold the arch support 20.

It is to be understood that the present invention is not limited to the embodiments described above, but encompasses any and all embodiments within the scope of the following claims.

I claim:

1. An arched pillow assembly, comprising:

a first fabric layer and a second fabric layer joined together to form a pillowcase, each of said first and second fabric layers having first and second laterally opposed ends;

a first pocket and a second pocket attached to the first fabric layer of the pillowcase, said first and second pockets being positioned adjacent the first and second laterally opposed ends, respectively, of the first fabric layer, said first and second pockets being joined to an exterior surface of the pillowcase;

an arch support having a rigid arcuate component and a layer of cushioning material covering the rigid arcuate component, the arch support having a radius of curvature forming an arm-receiving channel having a height and width dimensioned and configured for extending over an arm of a sleeping person, the arch support having laterally opposed first and second ends respectively received in the first and second pockets;

whereby the sleeping person may rest the person's head on the arch support without cutting off circulation to the arm beneath the arch support.

2. The arched pillow assembly according to claim 1, wherein said pockets are made from a resilient fabric material.

3. The arched pillow assembly according to claim 1, wherein said arcuate component is made from molded plastic.

4. The arched pillow assembly according to claim 1, further comprising a pillow disposed within the pillowcase.

5. The arched pillow assembly according to claim 1, wherein said pockets are permanently attached to said pillowcase.

6. The arched pillow assembly according to claim 1, wherein said pockets are removably attached to said pillowcase.

* * * * *